US005839451A

United States Patent [19]

Dorber et al.

[11] Patent Number: 5,839,451

[45] Date of Patent: Nov. 24, 1998

[54] IMPLEMENT FOR THE TREATMENT OF HAIR

[75] Inventors: Ralf Dorber, Schmitten; Dieter Liebenthal, Maintal; Peter Janouch, Linsengericht, all of Germany

[73] Assignee: Braun Aktiengesellschaft, Frankfurt, Germany

[21] Appl. No.: 769,339

[22] Filed: Dec. 19, 1996

[30] Foreign Application Priority Data

Aug. 16, 1996 [DE] Germany ..... 196 33 035.1

[51] Int. Cl.[6] ..... A45D 20/50

[52] U.S. Cl. ..... 132/271; 34/97; 601/95

[58] Field of Search ..... 132/118, 119.1, 132/271, 272, 228; 34/96, 97, 98; 15/110; 601/80, 95, 114

[56] References Cited

U.S. PATENT DOCUMENTS

| | | | |
|---|---|---|---|
| 1,948,167 | 2/1934 | Cornwell | 128/66 |
| 2,489,582 | 11/1949 | McCready | 15/22 |
| 2,676,347 | 4/1954 | Hershey | 15/22 |
| 2,753,434 | 7/1956 | Storm, Jr. | 219/39 |
| 2,806,235 | 9/1957 | Carstairs et al. | 15/22 |
| 3,358,309 | 12/1967 | Richardson | 15/22 |
| 3,370,583 | 2/1968 | Teranishi | 128/24.1 |
| 3,427,674 | 2/1969 | Tone et al. | 15/23 |
| 3,716,048 | 2/1973 | Alonso | 601/95 |
| 3,820,551 | 6/1974 | Lanzillotta | 132/11 |
| 3,840,030 | 10/1974 | Baker . | |
| 3,853,133 | 12/1974 | Komatsu et al. | 132/119.1 |
| 3,890,984 | 6/1975 | Lesetar | 132/271 |
| 3,894,547 | 7/1975 | Scivoletto | 132/119.1 |
| 3,949,765 | 4/1976 | Vallis | 132/11 R |
| 3,970,093 | 7/1976 | Lardenois | 132/9 |
| 3,981,314 | 9/1976 | Barradas | 132/9 |
| 4,132,360 | 1/1979 | Lee, Jr. | 239/383 |
| 4,197,448 | 4/1980 | Harigai | 219/370 |
| 4,295,283 | 10/1981 | Tomaro | 34/97 |

(List continued on next page.)

FOREIGN PATENT DOCUMENTS

| | | | |
|---|---|---|---|
| 2 297 015 | 8/1976 | France | A45D 20/52 |
| 826 953 | 1/1952 | Germany . | |
| 24 15 633 | 10/1975 | Germany | A45D 19/02 |
| 25 29 816 A1 | 1/1977 | Germany | A45D 20/10 |
| 28 04 820 | 8/1979 | Germany | A45D 20/50 |
| 31 07 787 | 9/1982 | Germany | A61H 33/12 |
| 37 08 126 | 9/1988 | Germany | B06B 1/16 |
| 39 06 265 A1 | 8/1990 | Germany | A45D 20/10 |
| 90 12 981 U | 2/1992 | Germany | A45D 20/12 |
| GM 93 05 195.6 | 7/1993 | Germany | A45D 20/12 |
| 52-23457 | 2/1977 | Japan | A45D 20/48 |
| 52-105058 | 9/1977 | Japan | A45D 20/50 |
| 53-4656 | 1/1978 | Japan | A45D 20/50 |
| 53-761 | 1/1978 | Japan | A45D 20/50 |
| 53-31457 | 3/1978 | Japan | A45D 20/50 |
| 54-10060 | 1/1979 | Japan | A45D 20/50 |
| 64-72706 | 3/1989 | Japan | A45D 20/12 |
| 4-156802 | 5/1992 | Japan | A45D 20/12 |
| 396845 | 8/1933 | United Kingdom . | |
| 924139 | 4/1963 | United Kingdom | 34/97 |
| 1456516 | 11/1976 | United Kingdom | A45D 24/10 |
| 1 471 992 | 4/1977 | United Kingdom | A45D 20/50 |
| 2 237 734 | 5/1991 | United Kingdom | A46B 13/02 |
| WO 91/08690 | 6/1991 | WIPO | A45D 20/48 |
| WO 95/04485 | 2/1995 | WIPO | A45D 20/12 |
| WO 95/17836 | 7/1995 | WIPO | A45D 20/12 |

*Primary Examiner*—Todd E. Manahan
*Attorney, Agent, or Firm*—Edward S. Podszus

[57] ABSTRACT

The invention is directed to an implement for the treatment of hair, particularly for the styling and/or drying of hair, which is adapted to be connected with the air exit end of a personal-care appliance through which air flows, in particular of a hair dryer or a hot-air curling brush. The implement is comprised of a main body and at least one active body movable relative to the main body, for example a supporting structure carrying several hair pick-up elements. An electric drive mechanism, in particular an electric motor, is provided on the implement for moving the active body.

68 Claims, 6 Drawing Sheets

U.S. PATENT DOCUMENTS

| | | | |
|---|---|---|---|
| 4,391,047 | 7/1983 | Janssens et al. | 34/97 |
| 4,409,998 | 10/1983 | Bauer | 34/96 |
| 4,664,132 | 5/1987 | Schillig . | |
| 4,864,735 | 9/1989 | Chung | 34/90 |
| 5,054,211 | 10/1991 | Shulman | 34/97 |
| 5,091,630 | 2/1992 | Djuric | 219/222 |
| 5,161,317 | 11/1992 | McDougall | 34/97 |
| 5,275,339 | 1/1994 | Andis et al. | 239/443 |
| 5,341,578 | 8/1994 | Anderson | 34/97 |
| 5,392,528 | 2/1995 | McDougall | 34/97 |
| 5,457,894 | 10/1995 | Dorber | 34/98 |
| 5,471,695 | 12/1995 | Aiyar | 15/22.1 |
| 5,488,783 | 2/1996 | Parkinson et al. | 34/98 |
| 5,511,270 | 4/1996 | Eliachar et al. | 15/22.1 |
| 5,622,192 | 4/1997 | Chiou | 132/112 |
| 5,628,123 | 5/1997 | Chan | 34/90 |
| 5,671,547 | 9/1997 | Truchet et al. | 34/96 |

A 5
3
4
9
7
8
15
16
17
14
21
12
18
13
11
10
2
20
19
6

IMPLEMENT FOR THE TREATMENT OF HAIR

This invention relates to an implement for the treatment of hair, particularly for the styling and/or drying of hair. The implement is adapted to be connected with the air exit end of a personal-care appliance through which air flows, particularly of a hair dryer or a hot-air curling brush. The implement comprises a main body and at least one active body being movable relative to the main body, for example, a supporting structure carrying several hair pick-up elements.

Auxiliary implements for use with a hair dryer as well as hair treatment appliances with actively movable components are known in the art. WO 95/17836, for example, discloses an accessory for a hair dryer, which is connected with the air exit opening of a hair dryer and through which the air current generated in the hair dryer flows. This implement includes elements, for example, bristles or hair treatment fingers, which can be brought into contact with the user's hair. Further, this accessory includes vibratory means causing the bristles or fingers to vibrate during the drying operation. The vibrating action is generated in that, for example, a movable membrane supporting the fingers is arranged at the air exit end of the accessory, and an impeller with flyweight provided at the rear of the membrane is driven by the air current.

From U.S. Pat. No. 3,840,030 there is known a hair dryer with a hair detangling means which essentially comprises two combs in a parallel arrangement that are adapted to be connected via a transmission means with an electric motor arranged in the hair dryer housing. The combs are adapted to be driven by the motor such that they perform a fast reciprocating linear movement. In this arrangement, the motor provided to drive the detangling comb is disposed inside the hair dryer housing.

Further, from GB 2 237 734 there is known a hair brush with vibratory bristles which are positioned on a flexible rubber-type support plate. In the brush is an electric motor equipped with a flyweight, which excites the complete brush body to vibration in order to intensify the brushing effect or also loosen the hair.

In the case of the above described appliances it has proven to be disadvantageous that with one appliance the vibratory drive mechanism excited by the air current requires a long start-up period and that the movement of the bristles or fingers on the scalp occurs irregularly. It may even happen that the movement of the bristles or fingers on the scalp is interrupted as soon as the contact force of the bristles or fingers on the scalp is sufficiently high. With another appliance it is a disadvantage that the motor for actuation of the detangling comb has to be held and moved by the user even when the detangling comb is not attached to the hair dryer and is not used.

It is an object of the present invention to eliminate the above mentioned disadvantages and to provide an implement for the treatment of hair, particularly for the styling and/or drying of hair, which is adapted to be connected with the air exit end of a hair dryer and enables reliable assistance and intensification of the volume-creating effect on the hair, particularly a simpler and more effective generation of volume than in the case of hitherto known appliances while the hair is being dried. It is a further object to achieve with this implement a uniform volume-creating effect on the hair as well as a pleasant sensation on the user's scalp during the treatment.

According to the present invention, these objects are accomplished with a hair treatment implement incorporating the above known technical features by providing an electric drive mechanism, in particular an electric motor, on the implement for moving the active body. A controlled variable movement of the active body, for example of the supporting structure carrying the hair pick-up elements, as well as an extremely short start-up period for the movement of the active body are achieved by using the electric drive mechanism. The desired volume-creating effect is thus assisted and intensified advantageously during the hair styling and hair drying process, in particular a uniform volume-creating effect on the hair is enabled at all the treated areas of the user's head. Further, as a result of the electric drive mechanism and in particular as a result of the automated movement of the active body, a simpler volume-creating effect is advantageously assured than in the case of a manual hair treatment or a hair treatment using a corresponding implement of the prior art. Further, an electric drive mechanism such as an electric motor for moving the active body is a simple, low-cost and mass-produced component that can be used to accomplish the object identified in the foregoing.

In a further configuration of the present invention, the electric drive mechanism is connected with an oscillation generator, with the drive mechanism being, for example, an electric motor or, alternatively, a magnetic, inductive or similar drive means. This affords the advantage of a controllable and variable generation of oscillations.

In a particular further configuration, the electric motor is provided with a flyweight mounted eccentrically on the motor shaft. Advantageously, a simple, easy-to-manufacture component for low-cost mass production is thus provided, creating a pleasant sensation on the user's scalp during treatment.

In a further configuration of the present invention, a device is provided for the open- and/or closed-loop control of the rotational frequency of the electric motor. In addition to the fast and reliable availability of the electric driving motor, a further variation possibility is thereby provided, with the attendant advantage of enabling the setting of a pleasant oscillation frequency and/or oscillation amplitude for the respective user.

In addition, the electric motor is also adapted to be connected with a transmission so that further influencing of the rotational frequency of the motor and hence of the movement of the active body can be accomplished advantageously.

The electric motor is in particular a direct-current motor which is arranged in the interior of the implement. For one purpose, this advantageously enables the separation of the motor from the hair dryer, eliminating the need for the user to hold and carry it in cases where the implement is not attached to the hair dryer. For another purpose, the motor is thus protected and arranged in the interior of the implement out of the user's sight. As a result of the small overall size of a direct-current motor, the latter requires only little space in the interior of the implement.

In a particular further configuration of the implement, it is proposed arranging the electric motor so that the motor shaft extends in a direction essentially transverse to the main axis of the implement and particularly transverse to the main direction of alignment of the hair pick-up elements. In a hair treatment implement whose hair pick-up elements extend essentially parallel to the direction of main flow, the motor is arranged vertically to the direction of main flow and hence radially within the implement. As a result of this arrangement, the maximum possible oscillating movement of the active body is achieved advantageously so that nearly all the hair pick-up elements perform an oscillating movement at their downstream ends.

Further, if in accordance with a further feature of the present invention the electric motor and particularly the center of gravity of the electric motor is arranged eccentrically to the main axis of the implement, particularly an implement symmetrical about the axis, this also has an advantageous effect on the oscillating movement. As a result of this described arrangement of the electric motor it is possible to generate a notable oscillating movement or vibration on the hair pick-up elements even with a relatively small motor or with a motor of low power.

In a further configuration of the present invention, the electric motor is fitted, for example by means of a latch or screw connection, directly to the active body, particularly to the forward inside of the supporting structure as seen when looking in the direction of flow. As a result of the direct coupling of the motor with the active body to be moved, it is possible to achieve a best possible initiation of oscillations by the shortest route and without additional damping components. An automated manufacture is possible advantageously as a result of the provision of latches on the inside of the supporting structure or also as the result of screwing the motor to the supporting structure.

In another configuration, the electric motor is surrounded by a closed capsule. As a result, the motor is separated from the area of the active body through which the air flows, and a further mechanical and thermal protection of the motor is provided advantageously.

In this configuration, at its upstream end the capsule may include a flow baffle which is, for example, a deflector body arranged in front of the capsule at an inclination to the direction of main flow. For one purpose, the air flowing through the implement is thus subjected to minimum disturbance, and for another purpose the motor is protected from overheating by the heated air.

For supplying voltage to the electric drive mechanism in the implement, an electrical connection may be provided between the implement and the hair dryer or the curling brush. Hence an electrical connection between the implement and the hair dryer can be made advantageously as soon as the implement is attached to the dryer. Alternatively, it is possible to provide inside the implement itself a voltage supply operable independently of the hair dryer, for example a battery, an accumulator or a power pack, for driving the electric motor; hence the implement is advantageously independent of the hair dryer in its electric supply and is operable even when the hair dryer is switched off.

In a particularly advantageous further configuration of the present invention, which may also be an invention in its own right, it is proposed making the main body and the active body of the implement of a dimensionally stable, hard material, and providing between the two at least one connecting element made of an elastic material. Advantageously, a simple construction of the movable active body is achieved as a result of this arrangement of hard and soft, particularly elastic components, which enables good contact on the user's scalp, in addition to providing a defined elastic mounting in the main body.

In an advantageous further configuration of the connecting element between the main body and the active body, an elastic component, particularly a silicone hose, is used. The modulus of elasticity and the geometrical dimensions or the resilient and damping characteristics of the elastic component, particularly the hose, are advantageously variable, such that a simple, low-cost component adaptable to the respective characteristics required can be manufactured. On the one hand, the modulus of elasticity of silicone is a material constant, on the other hand the resilient and damping characteristics are variable by changing the geometrical dimensions, for example length and/or wall thickness. Advantageously, the resilient and damping characteristics are variable in a simple manner by using a hose with a thin or a thick wall. Further, by using silicone hose it is also possible at low cost to implement the simple production of hose sections to the required lengths by cutting from hose coils.

The hose is arranged substantially parallel to the main axis of the implement and hence also parallel to the direction of main flow in its interior so that it represents only a small flow resistance and advantageously suffers only slight heating.

In a particular configuration, several hose sections, in particular four, are arranged equidistantly to each other. Ease of assembly of the elastic connecting elements as well as a symmetrical mounting of the active body on the main body is thus proposed, enabling the active body to perform a uniform oscillating movement.

Alternatively to the above described hose arrangement parallel to the main axis of the implement, the hoses may also be arranged inclined relative to each other, for example on the covering surface of a fictive truncated cone, with the top of the truncated cone pointing in the direction of flow. Advantageously, the active body thus returns faster and more reliably to its position of rest.

Corresponding pin-type bases on which the hose sections can be plugged with their ends are provided on both bodies for mounting the active body on the main body. By conforming the outer diameter of the bases to the inner diameter of the hoses, ease of assembly and a reliable, low-cost mounting, in particular clamping, of the hose sections, is provided.

In a further configuration of the present invention, it is proposed manufacturing the main body, the active body and the elastic connecting element as a single-piece component, particularly as a two-component plastic injection molding. This provides a component which is comprised of two different materials, including a hard plastic material for the main and active bodies and a soft, elastic plastic material for the intermediate connecting element, such a component being advantageously suitable for automated production processes.

Stop means against which the hose sections come to rest before the active body makes contact with the housing are provided in the main body, particularly in the housing of the main body, to limit the oscillating movement of the active body.

In a further feature of the present invention, which may also represent an invention in its own right, the main body and the active body each comprise several modular components adapted for joining together in subassemblies. This modular construction enables a simple and low-cost production, also an automated production. Further, the replacement or change of individual components for a series is effected with greater ease and economy by using modular components in the series production of hair treatment implements.

The main body, which is stationary relative to the hair dryer, is comprised of a bell-type housing, a support cage arranged therein, and a cover plate. Advantageously, simple separation of the various functions performed by the main body is thus proposed by these components. The housing and the cover plate form the components visible from the outside while the support cage, which supports the active body, is not visible from the outside but inserted in the bell structure and adapted to be latch-connected therewith.

The active body, which is movable relative to the stationary main body, is comprised of a support plate having an electric motor mounted thereon as well as a front panel including finger-type hair pick-up elements. This afford s the advantage of enabling the electric motor to be initially mounted, for example latched, on the support plate and to be subsequently covered by the front panel.

In a further configuration of the present invention, the support cage, the support plate, the electric motor and the connecting elements, particularly the silicone hoses, form one sub-assembly which advantageously can be preassembled as such and tested as a function unit. This subassembly represents the connection between the stationary main body and the movable active body, thus forming the main subassembly of the implement.

It is further proposed that the above described subassembly be insertable in the bell-type housing of the main body and be subsequently closable with the cover plate. Ease of assembly of the subassembly, which contains the electric motor with the movable support plate, in the stationary housing is thus provided.

In a particular further configuration, the support cage is made of a material, particularly a plastic material, having a higher temperature resistance than the bell-type housing surrounding it on the outside. Since the support cage comes into contact with the hot air current, the housing may be manufactured advantageously from a material with a low temperature resistance.

It is proposed further that the support cage project beyond the bell-type housing in an upstream direction, that is, toward the air exit of the hair dryer. As a result, it is ensured advantageously that after the implement is mounted on the air exit end of the hair dryer, the hot air current impinges only on the inner lying support cage, and the housing itself and particularly its exterior is not exposed to any severe rise of temperature.

In a particular further configuration, the front panel carrying the finger-type hair pick-up elements is releasably connected with the support plate of the active body. This is accomplished in particular by means of latching hooks which, for example, are integrally formed with the front panel. Advantageously, this thus enables the ready release and removal of the front panel from the implement, which makes the use of the implement easy, for example, for cleaning purposes or for replacement of the panel carrying the fingers.

The front panel of the active body is shaped in the form of a triangle having concave sides and tips rounded in a convex configuration. Advantageously, storage space for the accommodation of additional units in the housing is thus provided in the corresponding triangles of an approximately circular cover plate encompassing the front panel on the outside in a circumferential direction.

A reliable and easy-to-actuate fastening means is proposed advantageously by the formation of a latching hook at each tip of the triangle of the front panel. Advantageously, the front panel is thus readily removable from the implement by the user releasing a latching hook.

In a preferred configuration of the present invention, the cover plate of the housing includes a central opening, with the shape of the opening corresponding substantially to the outer contour of the front panel of the active body. This enables a snug fit of the front panel in the cover plate, with a circumferential slot being provided between the two components so that the front panel with its hair pick-up elements is movable relative to the cover plate without the front panel knocking against the cover plate. Further, a unit such as the electric motor may be accommodated advantageously in the triangular zones of the cover plate, which are situated between two tips of the front panel, without said unit severely affecting the air current flowing through the implement.

The hair pick-up elements attached to the front panel advantageously have an area of cross-section which corresponds essentially to the shape of a triangle and which may be shaped, for example, with convex sides or also with concave sides and tips rounded in a convex configuration, whereby good hair pick-up and control may be achieved to advantage.

The support plate and the front panel are both equipped with screen-type air passageways so that with this arrangement a deceleration of the air flowing through the implement is achieved advantageously and gentler drying of the hair is made possible.

In another configuration of the present invention, provision is made for a slide switch being arranged on the bell-type housing for the purpose of mechanically and/or electrically connecting the implement to the hair dryer. Mechanical locking and the making of an electrical connection between the implement and the hair dryer can thus be accomplished advantageously with one simple manipulation after mounting the implement on an air exit end of the hair dryer.

In a further configuration, sliding-action contacts with contact bars are provided in the slide switch. Since the electric motor is electrically connected to the contact bars of the slide switch, for example by flexible leads, a reliable, low-wearing and durable electrical connection between the motor and the contacts is proposed which is subject to only minor wear when the implement is in use. When the slide switch is actuated, movement occurs only between the sliding-action contacts and the bars of the slide switch, which are advantageously of very low-wear design.

In a particularly preferred further configuration of the present invention, the downstream ends of the hair pick-up elements which are adapted to be placed on the user's head perform a movement, in particular an oscillating movement, with an amplitude in a radial plane, that is, substantially transverse to the main direction of alignment of the hair pick-up elements, and/or with an amplitude in an axial plane, that is, substantially parallel to the main direction of alignment of the hair pick-up elements. In a movement in both planes, the radial amplitude is advantageously greater than the axial amplitude, thereby intensifying the volume-creating effect on the hair effectively in addition to creating a pleasant sensation on the user's head. An appropriate distribution of the radial and axial components of movement is accomplished in that the resilient and damping characteristics as well as the stop limits of the elastic connecting elements are adjusted in the way described in the foregoing.

At their downstream ends the hair pick-up elements perform a movement, in particular in a radial plane, with an amplitude of 0 to 100 mm, this movement being a linear and/or a circular or a circular-arc-shaped movement. This also includes a movement of single or several hair pick-up elements relative to other, stationary hair pick-up elements. On the one hand, the magnitude of the amplitude depends on the position of the electric drive mechanism, for example the electric motor, on the support plate, as well as on the position of the respective hair pick-up element on the front panel, and on the other hand it is determined by the resilient and damping characteristics and by the stop limits. A preferred advantageous configuration of the movement of the downstream ends of the pick-up elements has an amplitude of 3 mm, approximately.

The hair pick-up elements, particularly the downstream ends of the hair pick-up elements, perform a movement at a frequency of between 0 Hz and 100 kHz; a preferred oscillation frequency of the pick-up elements is of the order of 60 Hz, approximately. Advantageous assistance and intensification of the volume-creating effect on the hair may be achieved at this frequency. Further, a movement of the hair pick-up elements at a frequency of 60 Hz, approximately, creates an additional pleasant sensation on the user's scalp.

In a particular further configuration of the present invention, a method of treating hair using an above described implement is proposed, which may also be considered an invention in its own right. With this method, the implement is placed on the user's head with the downstream ends of the hair pick-up elements, which causes the hairs to be picked up by the hair pick-up elements and to be lifted by the movement of the hair pick-up elements, preferably at the above mentioned frequency of 60 Hz, approximately, in the space between the hair pick-up elements in the direction of the front panel, drying quickly in this position. As this occurs, root lift as well as an improved more uniform volume can be given to the hair, and a pleasant sensation may be created on the user's scalp.

In a further particularly advantageous configuration of the present invention, a personal-care appliance through which air is adapted to flow, in particular a hair dryer or a hot-air curling brush, having an air entrance and an air exit end is proposed, which appliance is releasably connected with an implement of the type referred to in the foregoing so that the implement achieves its full advantageous effect in the styling and/or drying of hair.

Alternatively to the above configuration, the implement may also be integrally formed with the air exit end of a hair treatment appliance, whereby the processes of attaching and removing the implement are eliminated advantageously, and yet the implement still achieves its full advantageous effects.

Further features, advantages and application possibilities of the present invention will become apparent from the subsequent description of embodiments illustrated in more detail in the accompanying drawings. It will be understood that any single feature and any combination of single features described and/or represented by illustration form the subject-matter of the present invention, irrespective of their summary in the claims and their back reference.

DETAILED DESCRIPTION OF PREFERRED EMBODIMENTS

Figure 1:
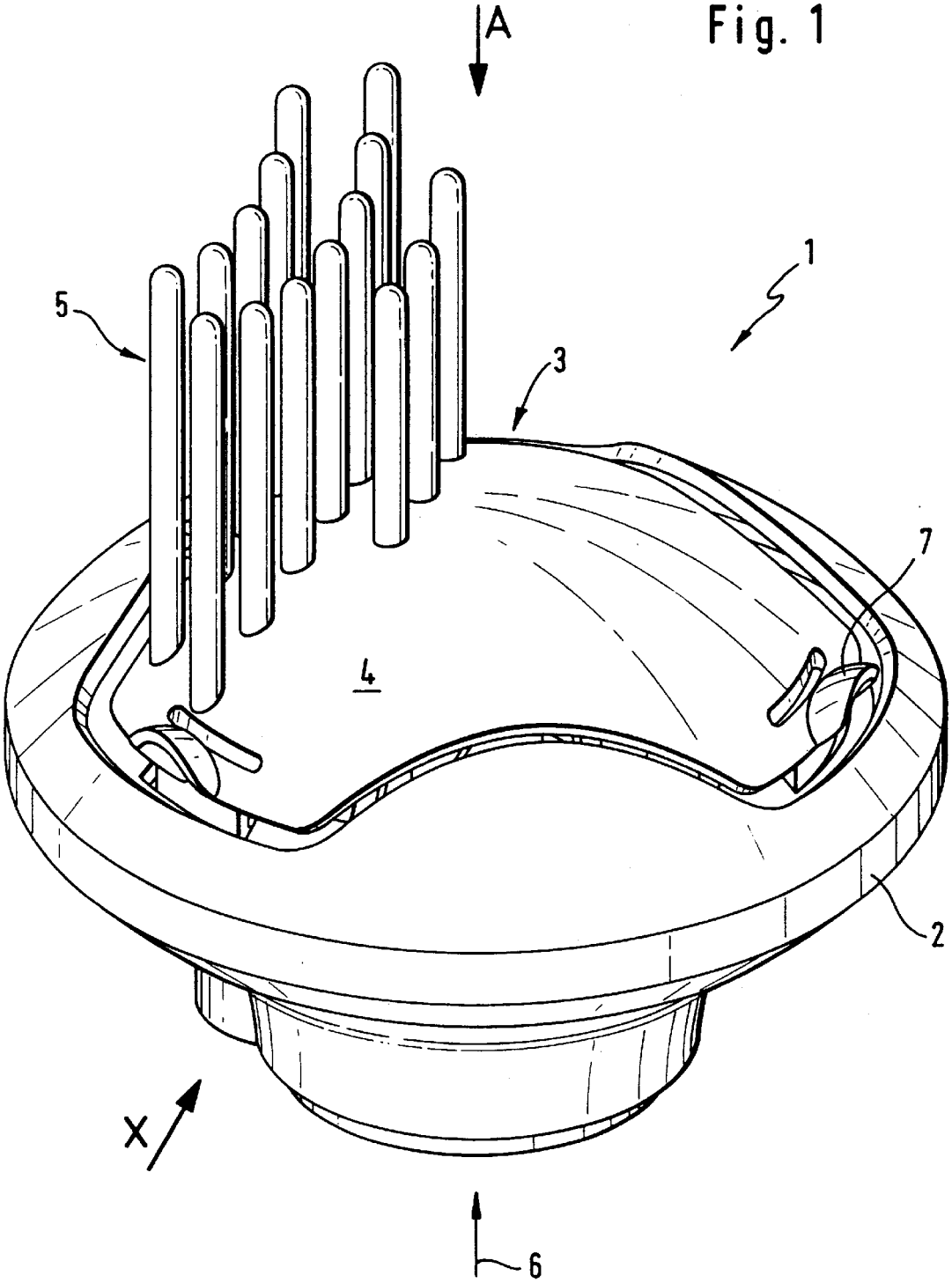
FIG. 1 is a perspective, schematic view of an implement with a main body and an active body.
Figure 7:
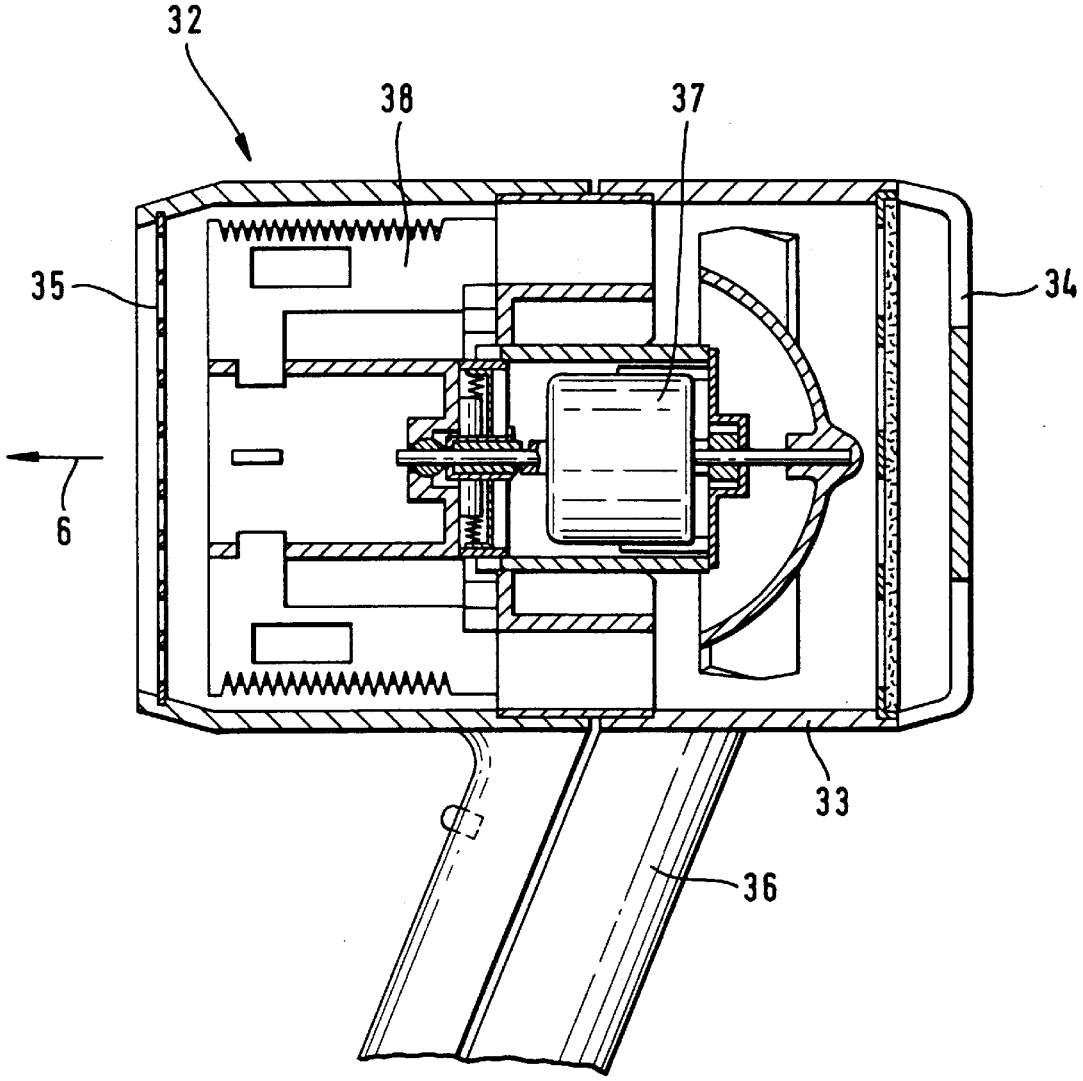
FIG. 7 is a schematic sectional view of a hair dryer.

An implement 1 according to the present invention (FIG. 1) for the styling and/or drying of hair comprises a bell-shaped main body 2 substantially symmetrical about the axis and an active body 3 attached therein and including a domed, substantially triangular front panel 4 having a plurality of finger-type hair pick-up elements 5 mounted thereon in relative parallel arrangement. Impinging upon the implement 1 in the direction of main flow 6 is an air current which is generated by a hair dryer not shown (See FIG. 7) and which exits the implement in an substantially unchanged direction of flow. The front panel 4 is provided with latching hooks 7 attached preferably to outer lying areas of the front panel in a circumferential direction. The latching hooks 7 are, for example, fixedly connected with the front panel 4.

Figure 2:
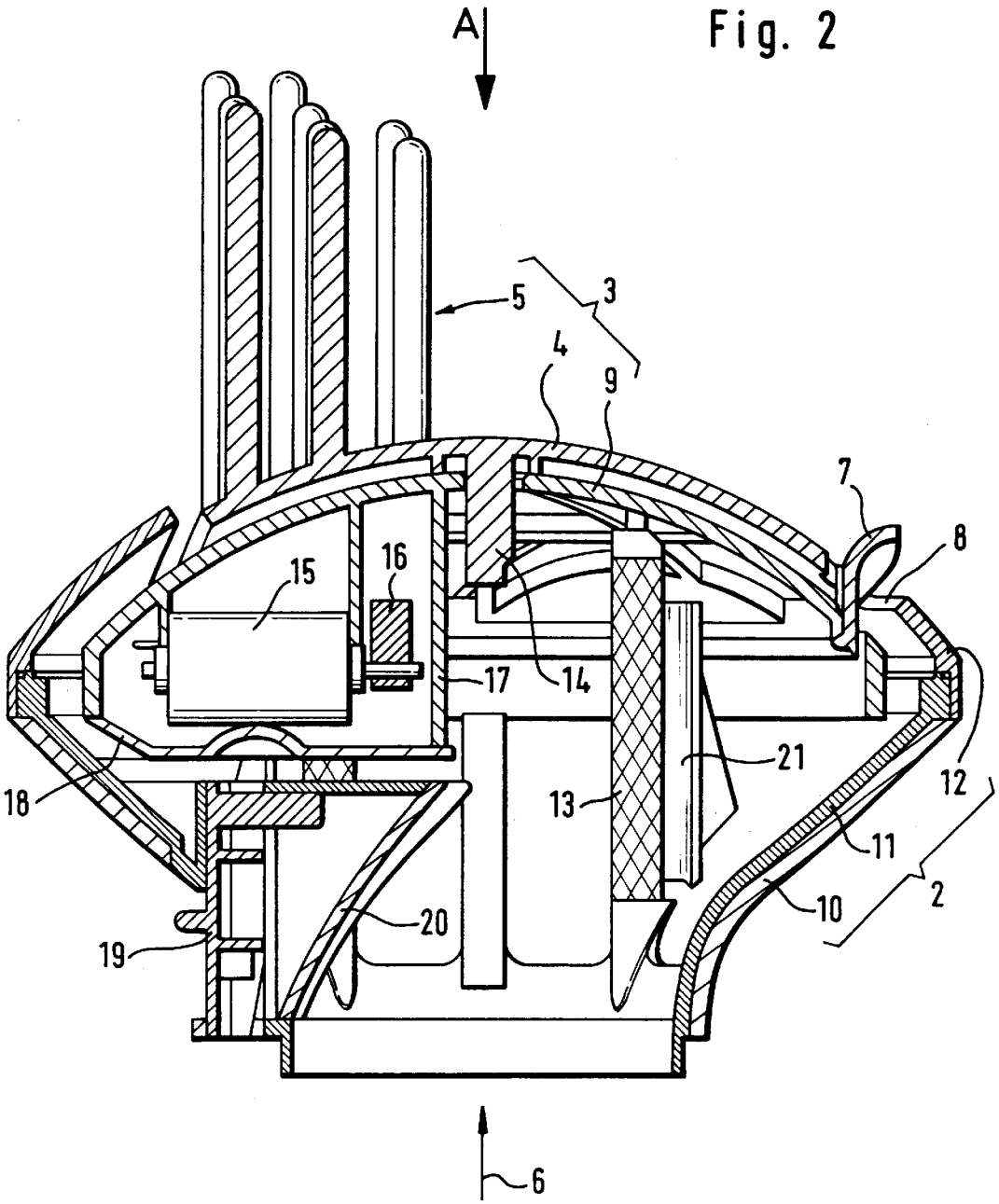
FIG. 2 is a longitudinal sectional view of an implement of FIG. 1.

The main body 2 (FIG. 2) comprises an outer bell-shaped housing 10 in which a support cage 11 is inserted with a snug fit and on which a cover plate 12 is seated. The cover plate 12 has a central opening 8 of a contour conforming substantially to the outer contour of the front panel 4. Bases, each for receiving one end of silicone hoses 13, are provided in the support cage 11. The opposite hose end is connected with mating bases of the support plate 9. The front panel 4 carrying the hair pick-up elements 5 is attached to the support plate 9 by means of a central pin 14. The components 4, 5 and 9 combine to form the active body 3 which is movable relative to the main body 2.

Stops 21 associated with each individual silicone hose 13 are provided in the bell structure 10 for lateral limitation of the movement of the active body 3. The shortest lateral distance, in the position of rest, between a hose 13 and a stop 21 is dimensioned such that the active body 3 does not abut against the main body 2.

The electric motor 15 with its flywheel 16 is accommodated in the interior of the support plate 9. It is latch-connected or snap-fitted to the support plate 9 by means of cleats, for example. Further, the motor 15 is completely encapsulated by a housing wall 17 and a lid 18, resulting in both a mechanical and a thermal protection of the motor 15. Still further, a wind baffle 20 with a side wall arranged at a slanting angle to the direction of main flow 6 is provided upstream from the motor capsule so that the motor 15 is incapable of being struck directly by the air current, nor does it represent any great obstruction to the flow in the interior of the main body 2.

The motor 15 is connected by flexible leads with a slide switch 19 which is arranged on an outer side of the main body 2. Contact bars and contact terminals are arranged in the slide switch 19 so that the terminals are moved along the bars when the slide switch 19 is actuated. Hence the flexible leads from the motor 15 to the switch 19 simply compensate for the movement of the active body 3 relative to the stationary main body 2.

Figure 3:
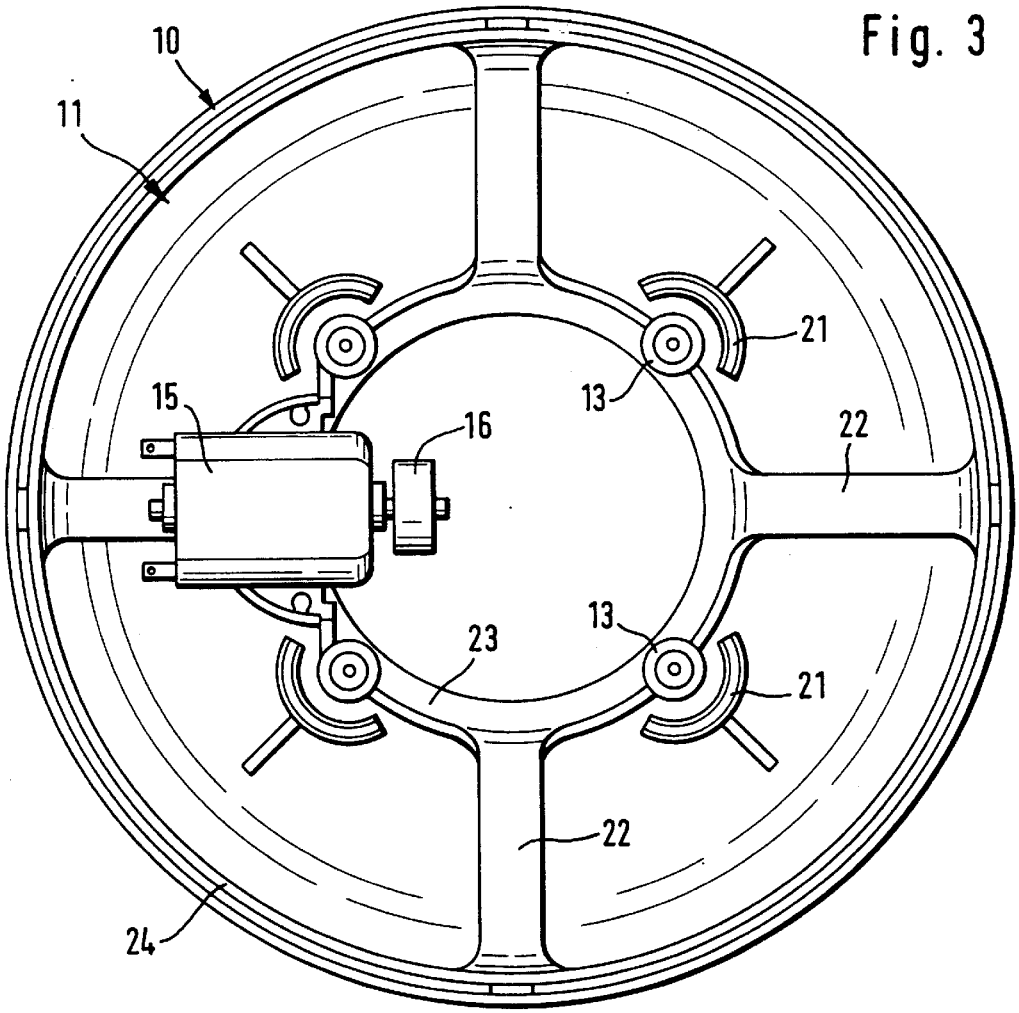
FIG. 3 is a top view of an implement with front panel and support plate removed, as seen when looking in the direction A of FIG. 2.

The support cage 11 (FIG. 3) is comprises an inner ring 23 and an outer ring 24 which are connected together by radial rib members 22. The stops 21 are arranged preferably in an arc around the connecting elements, in particular the silicone hoses 13, so that a stop limit for the active body is assured on all sides when there is movement.

The electric motor 15 is arranged inside the main body 2 in such a manner that its motor shaft extends approximately in a radial direction of the main body which is substantially symmetrical about its axis. The position of the center of gravity of the motor 15 is selected so that the motor is eccentric to the axis of rotation of the main body 2 and the flyweight 16 is positioned slightly outside the axis of rotation of the main body 2.

Figure 4:
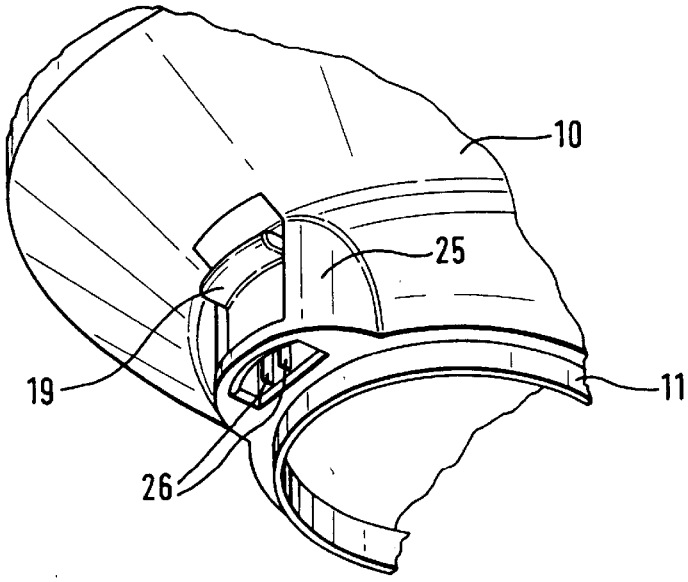
FIG. 4 is a perspective view of the slide switch as seen when looking in the direction X of FIG. 1.

The slide switch 19 (FIG. 4) is accommodated in a knapsack-type switch housing 25 on the bell-shaped housing 10. Contacts 26 are provided in an opening at its upstream end and are displaced on movement of the switch 19 in the direction of a hair dryer, not shown, likewise toward the dryer. The support cage 11 projects beyond the housing 10 at its upstream end.

Figure 5:
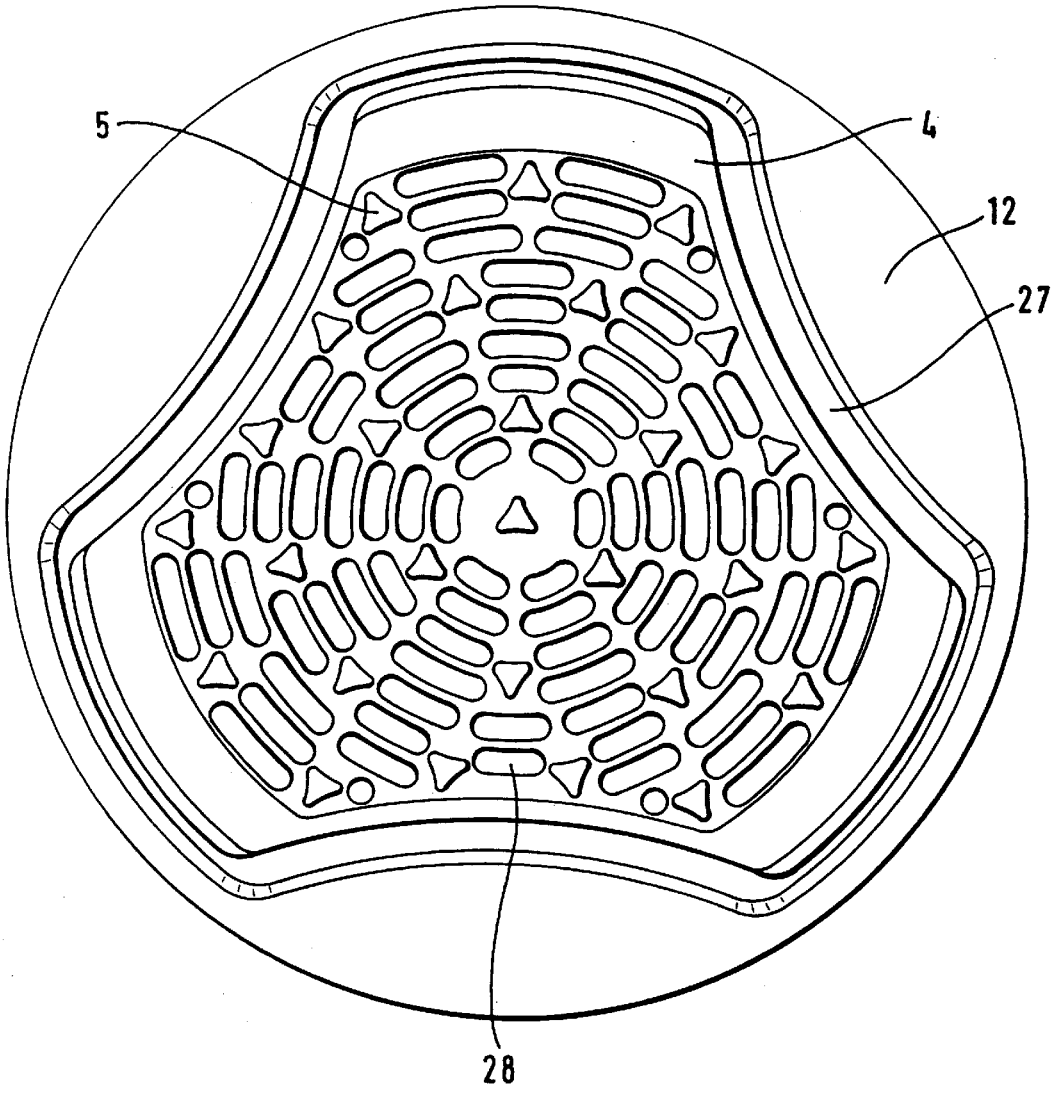
FIG. 5 is a top view of an implement as seen when looking in the direction A of FIG. 2.

Seen from the top, the front panel 4 (FIG. 5) is of substantially triangular shape having concave sides and tips rounded in a convex configuration. A plurality of hair pick-up elements 5 and slot-type air exit openings 28 are arranged on the front panel 4, with the elements 5 and the openings 28 being provided on a plurality of circles in concentric arrangement relative to each other. In this arrangement, the area of cross-section of the hair pick-up elements 5 corresponds approximately to the contour of the front panel 4. The front panel 4 is arranged inside the cover plate 12, with a circumferential slot 27 being provided between the inner contour of the plate 12 and the outer contour of the panel 4. The width of this slot is selected so that the front panel 4 does not make contact with the cover plate 12 when there is movement, in particular a vibratory movement.

Figure 6:
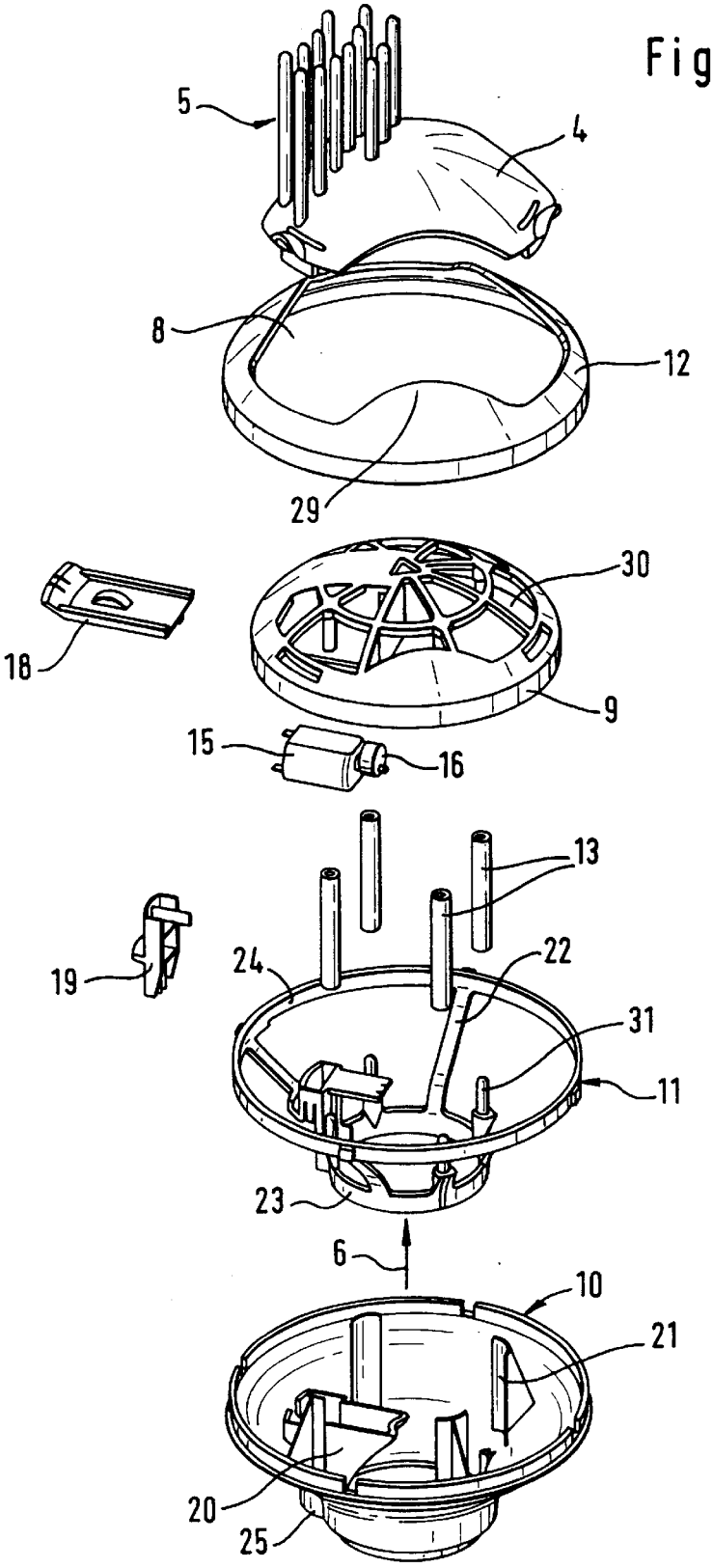
FIG. 6 is an exploded view of an implement of FIG. 1.

An implement 1 (FIG. 6) is adapted to be divided substantially into two groups of components, including those which are connected rigidly with a hair dryer and hence are stationary, such as the housing 10, the support cage 11 and the cover plate 12. The second group of components comprises the support plate 9 with the electric motor 15 and the front panel 4, these parts being movably connected with the stationary components via the silicone hoses 13.

To assemble the implement constructed in accordance with the present invention, for example first the silicone hoses 13 are plugged on the pins 31 in the support cage 11. The motor 15 is snap-fitted in the support plate 9 and closed with the lid 18. The support plate 9 is then connected with the still free ends of the hoses 13. The slide switch 19 is inserted in the housing 10 and the subassembly comprising the support plate 9, the motor 15 and the support cage 11 can then be inserted in the housing 10 and latched. The cover plate 12 is then mounted on the housing 10 so that the radially inwardly extending cavity 29 of the plate 12 covers the motor 15 at least partly. In a final operation, the front panel 4 carrying the finger-type hair pick-up elements 5 is mounted on a central bearing structure of the support plate 9 and is fastened to the support plate 9 by means of the latching hooks 7.

A hair dryer 32 (FIG. 7) substantially comprises a housing 33 having an air entrance opening 34 and an air exit opening 35 as well as a handle 36. A motor 37 with an impeller for generating an air current and a heating means 38 for heating the air current exiting the housing 33 in the direction of main flow 6 are received in the housing 33. The above described implement for the styling and drying of hair according to the present invention is mounted on the air exit opening 35 of the dryer 32, for example by means of a bayonet-type locking means known in the art.

We claim:

1. An implement for the treatment of hair adapted to be connected with an air exit of an air-moving hair-care appliance, said implement comprising:

a main body adapted to be connected to said air exit and defining an upstream air entrance opening and a downstream air discharge opening, an active body movable relative to the main body, and an electric driver generating a motive force and mounted on the implement in operative engagement with the active body for moving the active body, said electric driver being mounted on the active body.

2. The implement for the treatment of hair as claimed in claim 1, wherein the main body defines an interior chamber adapted to receive an air flow from said air exit of said appliance, the active body further comprises a support structure having an upstream surface directed towards said interior chamber, and wherein the electric driver is mounted on said upstream surface.

3. The implement for the treatment of hair as claimed in claim 1, wherein the electric driver comprises a motor.

4. The implement for the treatment of hair as claimed in claim 3, wherein the motor further comprises a controller controlling the rotational frequency of the motor, said controller being selected from a group consisting of open-loop and closed-loop systems.

5. The implement for the treatment of hair as claimed in claim 3, further including a transmission connected with the electric motor.

6. The implement for the treatment of hair as claimed in claim 3, wherein the electric motor is mounted on an interior surface of the implement.

7. The implement for the treatment of hair as claimed in claim 3, wherein the electric motor is arranged so that a motor shaft extends in a direction transverse to a major longitudinal axis of the implement.

8. The implement for the treatment of hair as claimed in claim 3, wherein the electric motor comprises a flywheel mounted eccentrically on a motor shaft.

9. The implement for the treatment of hair as claimed in claim 3 wherein the electric motor is arranged so that a motor shaft extends in a direction transverse to a principal axis of the major portion of the hair pick-up elements.

10. The implement for the treatment of hair as claimed in claim 1, wherein the electric driver is surrounded by a substantially closed capsule.

11. The implement for the treatment of hair as claimed in claim 10, wherein the capsule further comprises a flow baffle disposed on an upstream surface thereof.

12. The implement for the treatment of hair as claimed in claim 1, wherein the implement further comprises an electric socket to which a supply voltage can be applied to the electric driver.

13. The implement for the treatment of hair as claimed in claim 1, wherein the implement further comprises a voltage supply operable independently of said air-moving appliance, said voltage supply selected from a group consisting of a battery, an accumulator, and a power pack.

14. The implement for the treatment of hair as claimed in claim 1, wherein a center of gravity of the electric driver is arranged eccentrically to a major longitudinal axis of the implement.

15. The implement for the treatment of hair as claimed in claim 1, wherein said electric driver vibrates the active body in more than one plane.

16. The implement for the treatment of hair as claimed in claim 1, wherein the main body comprises a slide switch arranged thereon for electrically connecting the implement to the hair-care appliance.

17. The implement for the treatment of hair as claimed in claim 16, wherein the slide switch comprises sliding action contacts and contact bars, the electric driver being electrically connected to the contact bars.

18. The implement for the treatment of hair as claimed in claim 16, wherein the slide switch further provides mechanical connection of the implement to the hair-care appliance.

19. The implement for the treatment of hair as claimed in claim 1, wherein the main body comprises a cover plate defining a central opening and the active body comprises a front panel disposed at least partially within said opening and having disposed thereon a plurality of hair-engaging elements, with the shape of said opening corresponding to the shape of the front panel.

20. The implement for the treatment of hair as claimed in claim 1, wherein the main body comprises a bell-type housing and a support cage disposed interiorly of the bell-type housing, said support cage being formed of a material having a temperature resistance at least as great as that of a material of the bell-type housing.

21. The implement for the treatment of hair as claimed in claim 1, wherein the main body further comprises at least one stop limiting the movement of the active body.

22. The implement for the treatment of hair as claimed in claim 1, wherein the main body and the active body each comprise at least first and second modular components joined together in subassemblies.

23. The implement for the treatment of hair as claimed in claim 1, wherein the main body comprises a bell-type housing and a support cage disposed interiorly of the bell-type housing, the support cage extending beyond the bell-type housing in a region of said upstream air entrance opening in an upstream direction.

24. The implement for the treatment of hair as claimed in claim 1, wherein the electric driver is connected with an oscillation generator for oscillating the active body.

25. An implement for the treatment of hair adapted to be connected with an air exit of an air-moving hair-care appliance, said implement comprising:

a main body adapted to be connected to said air exit and defining an upstream air entrance opening and a downstream air discharge opening, an active body movable relative to the main body, an electric drive mechanism mounted on the implement in operative engagement with the active body for moving the active body, and at least one connecting element comprising an elastic material and connecting the active body to the main body, wherein the main body further comprises a first housing member and a support cage adapted to be received within an interior of the first housing member, the active body further comprises a support plate having mounted thereon the electric drive mechanism, and the at least one connecting element being disposed between the support cage and the support plate, wherein said support cage, said support plate and said at least one connecting element form a subassembly.

26. The implement for the treatment of hair as claimed in claim 25, wherein the sub-assembly is insertable in the first housing member and is retained with a cover plate mounted to the main body.

27. An implement for the treatment of hair adapted to be connected with an air exit of an air-moving hair-care appliance, said implement comprising:

a main body adapted to be connected to said air exit and defining an upstream air entrance opening and a downstream air discharge opening, an active body movable relative to the main body, and an electric drive mechanism mounted on the implement in operative engagement with the active body for moving the active body, wherein the active body comprises a support plate having mounted thereon said electric drive mechanism, and a front panel having disposed thereon a plurality of finger-type hair pick-up elements.

28. The implement for the treatment of hair as claimed in claim 27, wherein the hair pick-up elements have an area of cross-section which corresponds to the shape of a triangle.

29. The implement for the treatment of hair as claimed in claim 27, wherein the front panel carrying the plurality of finger-type hair pick-up elements is releasably connected with the support plate.

30. The implement for the treatment of hair as claimed in claim 27, wherein the front panel (4) is shaped in the form of a triangle having, with respect to a center of said triangle, concave sides and tips rounded in a convex configuration.

31. The implement for the treatment of hair as claimed in claim 30, wherein a latching hook is provided at each tip of the front panel, each latching hook releasably connecting the front panel with the support plate.

32. An implement for the treatment of hair adapted to be connected with an air exit of an air-moving hair-care appliance, said implement comprising:

a main body adapted to be connected to said air exit and defining an upstream air entrance opening and a downstream air discharge opening, an active body movable relative to the main body, and an electric drive mechanism mounted on the implement in operative engagement with the active body for moving the active body, said implement further comprising at least one connecting element comprising an elastic material and connecting the active body to the main body, wherein the at least one connecting element comprises a rubber-like hose having modulus of elasticity providing resilient and damping characteristics.

33. The implement for the treatment of hair as claimed in claim 32, wherein there are a plurality of the hoses each of which at opposed ends thereof are retainably inserted on pin-type bases provided on each of the main body and the active body.

34. An implement for the treatment of hair adapted to be connected with an air exit of an air-moving hair-care appliance, said implement comprising:

a main body adapted to be connected to said air exit and defining an upstream air entrance opening and a downstream air discharge opening, an active body movable relative to the main body, wherein the active body comprises a support plate and a front panel having disposed thereon a plurality of hair-engaging elements, said support plate and front panel each comprising a respective air discharge screen defining a plurality of air passageways, and an electric drive mechanism mounted on the implement in operative engagement with the active body for moving the active body.

35. An implement for the treatment of hair adapted to be connected with an air exit of an air-moving hair-care appliance, said implement comprising:

a main body adapted to be connected to said air exit and defining an upstream air entrance opening and a downstream air discharge opening, an active body movable relative to the main body, and an electric drive mechanism mounted on the implement in operative engagement with the active body for moving the active body, said implement further comprising at least one compliant connecting element connecting the active body to the main body.

36. An implement for the treatment of hair adapted to be connected with an air exit of an air-moving hair-care appliance, said implement comprising:

a main body adapted to be connected to said air exit and defining an upstream air entrance opening and a downstream air discharge opening, an active body movable relative to the main body, and an electric drive mechanism mounted on the implement in operative engagement with the active body for moving the active body, said implement further comprising at least one connecting element comprising an elastic material and connecting the active body to the main body, wherein the at least one connecting element is disposed substantially parallel to a major longitudinal axis of the implement.

37. An implement for the treatment of hair adapted to be connected with an air exit of an air-moving hair-care appliance, said implement comprising:

a main body adapted to be connected to said air exit and defining an upstream air entrance opening and a downstream air discharge opening, an active body movable relative to the main body, and an electric drive mechanism mounted on the implement in operative engagement with the active body for moving the active body, wherein the active body comprises a front panel having disposed thereon a plurality of hair pick-up elements, wherein said hair pick-up elements have proximal and distal ends and a longitudinal axis connecting said proximal and distal ends, said distal ends located in an outward direction from said front panel, said distal ends of the hair pick-up elements contacting, when in use, the user's head with an oscillating movement having an amplitude in a radial plane substantially transverse to the longitudinal axis of the hair pick-up elements, and an amplitude in an axial plane substantially parallel to the longitudinal axis, with the radial plane amplitude being greater than the axial plane amplitude.

38. The implement for the treatment of hair as claimed in claim 37, wherein said radial plane amplitude is up to about 100 mm.

39. The implement for the treatment of hair as claimed in claim 38, wherein said radial plane amplitude is about 3 mm.

40. The implement for the treatment of hair as claimed in claim 37, wherein said distal ends of the hair pick-up elements oscillate at a frequency of up to about 100 kHz.

41. The implement for the treatment of hair as claimed in claim 37, wherein distal ends of a plurality of rows of hair pick-up elements oscillate with amplitudes in both the radial and axial planes.

42. An implement for the treatment of hair integrally formed with an air exit of an air-moving hair-care appliance, said implement comprising:

a main body communicating with said air exit and defining an upstream air entrance opening and a downstream air discharge opening, an active body movable relative to the main body, and an electric driver generating a motive force and mounted on the implement in operative engagement with the active body for moving the active body, said electric driver being mounted on the active body.

43. An implement for the treatment of hair adapted to be connected with an air exit of an air-moving hair-care appliance in combination with the hair-care appliance, said implement comprising:

a main body adapted to be connected to said air exit and defining an upstream air entrance opening and a downstream air discharge opening, an active body movable relative to the main body, and an electric driver generating a motive force and mounted on the implement in operative engagement with the active body for moving the active body, said electric driver being mounted on the active body.

44. The implement for the treatment of hair as claimed in claim 43, wherein the hair-care appliance is selected from a group consisting of a hair dryer and a hot air curling brush.

45. An implement for the treatment of hair adapted to be connected with an air exit of an air-moving hair-care appliance, said implement comprising:

a main body adapted to be connected to said air exit and defining an upstream air entrance opening and a downstream air discharge opening, an active body movable relative to the main body, and an electric drive mechanism mounted on the implement in operative engagement with the active body, wherein the electric drive mechanism oscillates the active body in a plurality of directions having respective accelerations relative to more than a single axis.

46. The implement for the treatment of hair as claimed in claim 45, wherein the electric drive mechanism is mounted to the active body.

47. An implement for the treatment of hair adapted to be connected with an air exit of an air-moving hair-care appliance, said implement comprising:

a main body adapted to be connected to said air exit and defining an upstream air entrance opening and a downstream air discharge opening, an active body movable relative to the main body, and an electric drive mechanism mounted on the implement in operative engagement with the active body for moving the active body, said implement further comprising at least one connecting element comprising an elastic material and connecting the active body to the main body, wherein there are at least four connecting elements arranged equidistantly to each other.

48. An implement for the treatment of hair adapted to be connected with an air exit of an air-moving hair-care appliance, said implement comprising:

a main body adapted to be connected to said air exit and defining an upstream air entrance opening and a downstream air discharge opening, an active body movable relative to the main body, and an electric drive mechanism mounted on the implement in operative engagement with the active body for moving the active body, said implement further comprising at least one connecting element comprising an elastic material and connecting the active body to the main body, wherein there are a plurality of said connecting elements spatially disposed at least partially intersecting a surface of a fictive truncated cone.

49. An implement for the treatment of hair adapted to be connected with an air exit of an air-moving hair-care appliance, said implement comprising:

a main body adapted to be connected to said air exit and defining an upstream air entrance opening and a downstream air discharge opening, an active body movable relative to the main body, and an electric drive mechanism mounted on the implement in operative engagement with the active body for moving the active body, said implement further comprising at least one connecting element comprising an elastic material and connecting the active body to the main body, wherein the main body, the active body and the at least one connecting element are manufactured as a single-piece two-component plastic injection molding.

50. An implement for the treatment of hair adapted to be connected with an air exit of an air-moving hair-care appliance, said implement comprising:

a main body adapted to be connected to said air exit and defining an upstream air entrance opening and a downstream air discharge opening, wherein the main body comprises a bell-type housing, a support cage disposed interiorly of the bell-type housing, and a cover plate, an active body movable relative to the main body, and an electric drive mechanism mounted on the implement in operative engagement with the active body for moving the active body.

51. An implement for styling hair adapted to be releasably connected with an air exit of an air-moving hair-care appliance in combination with said air-moving hair care appliance, said implement comprising a stationary housing adapted to be connected to said air exit and defining an upstream air entrance opening and a downstream air discharge opening, an active body movable relative to the stationary housing, a plurality of hair engaging elements mounted on the active body and engaging, when in use, the hair of a user, and an electric reciprocating drive mechanism mounted on the implement in operative engagement with the active body for vibrating the active body, wherein the reciprocating drive mechanism is mounted on the active body, whereby the vibrating hair engaging elements style the hair and stimulate the scalp of the user.

52. An implement for styling hair adapted to be releasably connected with an air exit of an air-moving hair-care appliance, said implement comprising:

a stationary housing adapted to be connected to said air exit and defining an upstream air entrance opening and a downstream air discharge opening, an active body movable relative to the stationary housing, a plurality of hair engaging elements mounted on the active body and engaging, when in use, the hair of a user, and an electric reciprocating drive mechanism mounted on the implement in operative engagement with the active body for vibrating the active body, wherein the reciprocating drive mechanism is mounted on the active body, whereby the vibrating hair engaging elements style the hair and stimulate the scalp of the user.

53. The implement for styling hair as claimed in claim 52, wherein the reciprocating drive mechanism comprises a motor.

54. The implement for styling hair as claimed in claim 53, wherein the motor includes a flywheel mounted eccentrically on a motor shaft.

55. The implement for styling hair as claimed in claim 54, wherein the hair engaging elements have a longitudinal axis connecting proximal ends and distal ends, said distal ends located in an outward direction from said active body and said proximal ends, and the motor is mounted on the implement so that the motor shaft extends in a direction generally transverse to the longitudinal axis of the hair engaging elements.

56. The implement for styling hair as claimed in claim 52, wherein the reciprocating drive mechanism has a center of gravity offset from a major longitudinal axis of the implement.

57. The implement for styling hair as claimed in claim 52, wherein the hair engaging elements comprise slender finger-like hair pick-up elements.

58. The implement for styling hair as claimed in claim 52, wherein the active body moves in a plurality of directions including at least one non-linear component of motion.

59. The implement for styling hair as claimed in claim 52, further comprising a plurality of connecting elements supporting the active body to the stationary housing, said connecting elements being at least partially compliant.

60. The implement for styling hair as claimed in claim 52, wherein the active body moves in more than one plane.

61. The implement for styling hair as claimed in claim 52, wherein the stationary housing has a major axis directed generally parallel to a longitudinal axis of the plurality of hair engaging elements and the reciprocating drive mechanism does not accelerate the active body uniformly relative to said major axis, thereby gyrating the active body relative to the stationary housing.

62. An implement for styling hair adapted to be releasably connected with an air exit of an air-moving hair-care appliance, said implement comprising a stationary housing adapted to be connected to said air exit and defining an upstream air entrance opening and a downstream air discharge opening, an active body movable relative to the stationary housing, a plurality of hair engaging elements mounted on the active body and engaging, when in use, the hair of a user, and an electric reciprocating drive mechanism mounted on the implement in operative engagement with the active body for vibrating the active body, whereby the vibrating hair engaging elements style the hair and stimulate the scalp of the user, wherein the hair engaging elements have a longitudinal axis connecting proximal ends and distal ends, said distal ends located in an outward direction from said active body and said proximal ends, and the hair engaging element distal ends oscillate with a first component of motion in a first plane, said first plane being generally transverse to the hair engaging element longitudinal axis, and with a second component of motion in a second plane, said second plane generally parallel to the hair engaging element longitudinal axis.

63. The implement for styling hair as claimed in claim 62, wherein at least one of the first and second components of motion is at least partially arcuate.

64. The implement for styling hair as claimed in claim 62, wherein an amplitude of the first component of motion is at least as great as an amplitude of the second component of motion.

65. An implement for styling hair adapted to be releasably connected with an air exit of an air-moving hair-care appliance, said implement comprising a stationary housing adapted to be connected to said air exit and defining an upstream air entrance opening and a downstream air discharge opening, an active body movable relative to the stationary housing, a plurality of hair engaging elements mounted on the active body and engaging, when in use, the hair of a user, an electric reciprocating drive mechanism mounted on the implement in operative engagement with the active body for vibrating the active body, and a plurality of compliant connecting elements supporting the active body to the stationary housing, whereby the vibrating hair engaging elements style the hair and stimulate the scalp of the user.

66. An implement for styling hair adapted to be releasably connected with an air exit of an air-moving hair-care appliance, said implement comprising a stationary housing adapted to be connected to said air exit and defining an upstream air entrance opening and a downstream air discharge opening, an active body movable relative to the stationary housing, wherein the active body moves relative at least two axes, a plurality of hair engaging elements mounted on the active body and engaging, when in use, the hair of a user, and an electric reciprocating drive mechanism mounted on the implement in operative engagement with the active body for vibrating the active body, whereby the vibrating hair engaging elements style the hair and stimulate the scalp of the user.

67. A method of treating hair comprising the steps of:

providing, on an implement for styling hair for an air-moving appliance for personal use, a main body having a stationary housing, an active body connected to a reciprocating drive mechanism and movable relative to the stationary housing the active body further comprising a supporting panel having a plurality of air exit apertures and carrying a plurality of prongs arranged adjacent each other and having distal ends located in an outward direction from the air exit apertures, contacting the distal ends of at least a portion of the plurality of the prongs with the scalp of the user, reciprocating the active body relative to the main body, oscillating the distal ends of said portion of the plurality of prongs along the scalp and between hairs, and lifting the hairs away from the scalp between said portion of the plurality of prongs contacting the scalp, whereby a flow of air exiting the exit apertures dries the lifted hairs to provide volume in the hair, and the oscillating prong ends stimulate the user's scalp.

68. The method of claim 67, wherein the step of oscillating further comprises oscillating the prong distal ends at a frequency of about 60 Hz.

* * * * *